US010612310B2

(12) United States Patent
Vincent

(10) Patent No.: US 10,612,310 B2
(45) Date of Patent: Apr. 7, 2020

(54) LOCKING BIT RETENTION SYSTEM

(71) Applicant: Numa Tool Company, Thompson, CT (US)

(72) Inventor: Nathaniel F. Vincent, Pomfret, CT (US)

(73) Assignee: Numa Tool Company, Thompson, CT (US)

( * ) Notice: Subject to any disclaimer, the term of this patent is extended or adjusted under 35 U.S.C. 154(b) by 176 days.

(21) Appl. No.: 15/786,884

(22) Filed: Oct. 18, 2017

(65) Prior Publication Data

US 2018/0112470 A1 Apr. 26, 2018

Related U.S. Application Data

(60) Provisional application No. 62/410,956, filed on Oct. 21, 2016.

(51) Int. Cl.

| | |
|---|---|
| ***E21B 10/36*** | (2006.01) |
| ***E21B 17/043*** | (2006.01) |
| ***E21B 12/00*** | (2006.01) |
| ***E21B 4/06*** | (2006.01) |

(52) U.S. Cl.

CPC ..... *E21B 10/36* (2013.01); *E21B 4/06* (2013.01); *E21B 12/00* (2013.01); *E21B 17/043* (2013.01)

(58) Field of Classification Search

CPC ..... E21B 10/36; E21B 12/00; E21B 7/043; E21B 4/06

See application file for complete search history.

(56) References Cited

U.S. PATENT DOCUMENTS

| | | | | |
|---|---|---|---|---|
| 5,065,827 | A * | 11/1991 | Meyers | E21B 4/14 175/293 |
| 2011/0036636 | A1* | 2/2011 | Lyon | E21B 4/14 175/293 |
| 2013/0043874 | A1* | 2/2013 | Clark | E21B 10/00 324/369 |
| 2016/0153236 | A1* | 6/2016 | Marshall | E21B 10/36 175/57 |
| 2017/0241213 | A1* | 8/2017 | Boswell | E21B 17/076 |

* cited by examiner

*Primary Examiner* — Caroline N Butcher

(74) *Attorney, Agent, or Firm* — Alix, Yale & Ristas, LLP

(57) ABSTRACT

A bit retention system for a hammer drill including a housing (41), a drive sub (44) connected to lower end of the housing, and a bit retainer (50) having an upper end suspendable from a shoulder of the drive sub and a lower end including a radially inwardly projecting bit retention rim (52). The upper end of a locking sleeve (70) has internal features (78) that are engageable with external features (76) at the lower end of the housing to prevent relative rotation, and a lower end sized (82) to overlap the upper end (90) of the retainer. The lower end of the locking sleeve is welded to the retainer, thus locking the threads on the drive sub from unscrewing from housing threads. The drive sub and retaining member are pinned together to stop separate rotation.

16 Claims, 6 Drawing Sheets

LOCKING BIT RETENTION SYSTEM

BACKGROUND

The present invention relates to percussion hammers, and particularly to a retention system for the hammer bit.

U.S. Pat. No. 5,065,827, "Hammer Bit Retention Tool", identifies a problem sometimes encountered during drilling operations. The bit can fail due to cyclic fatigue, by fracturing below the retaining rings and above the bit head. When this occurs during the drilling operation, the lower section of the bit is left at the bottom of the hole, thereby necessitating a costly and cumbersome fishing operation.

The '827 patent discloses a solution that comprises a hammer-percussion bit assembly having a cylindrical retaining member mounted on the exterior of the drive sub. The retaining member extends downwardly therefrom to extend over the upper portion of the bit head section. The lower end of the retaining member includes an inner projection which is adapted to be threaded through the fishing thread of the bit and extend around a reduced section of the bit. The reduced section of the bit extends a predetermined distance sufficient to enable the bit to move and reciprocate during operation without interference from the retaining member. Should the bit bottom section break away from the bit shank, the retaining member will grab on to the fishing thread portion of the bit head section to retain the bit section until the entire drill string is lifted out of the hole.

Although the solution described in the '827 patent ameliorates the problem to some extent, an ancillary problem has been encountered, in that the drive sub can become unscrewed from the housing.

SUMMARY

The present invention improves upon the retention system of the '827 patent, by providing a locking sleeve connected between the housing and the retainer, for preventing relative rotation between the drive sub and the housing.

The locking sleeve comprises a tubular cylinder having upper and lower ends, with the upper end having an inner wall with features that are engageable with external features at the lower end of the housing to prevent relative rotation and a lower end sized to overlap the upper end of the retainer when the upper end of the locking sleeve engages the lower end of the housing.

Once assembled and tightened, the locking sleeve is then welded to the retaining member around the lower circumference of the sleeve, thus locking the threads on the drive sub from unscrewing from housing threads. The drive sub and retaining member are pinned together to stop separate rotation.

DETAILED DISCLOSURE

Figure 1:
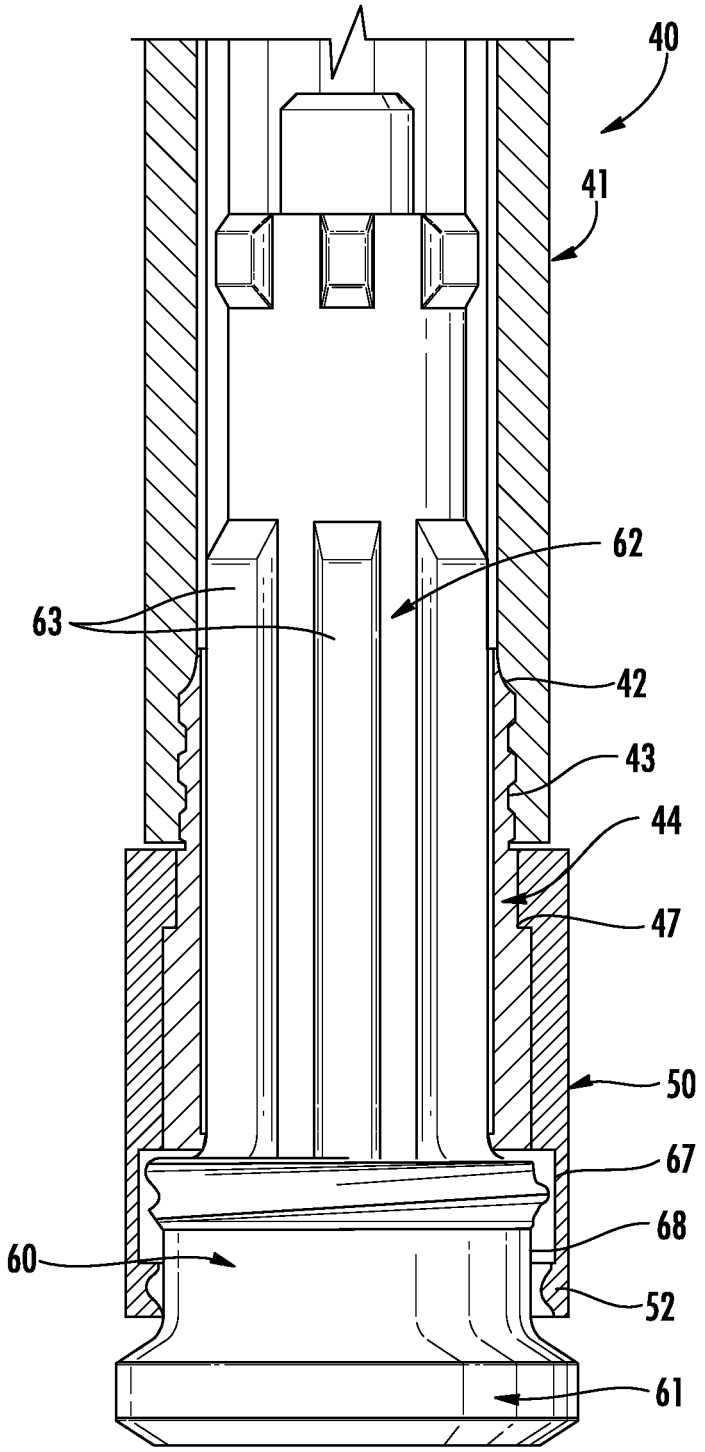
FIG. 1 PRIOR ART
FIG. 1 shows the bit region of a drill according to the prior art.

The salient aspects of the invention will be described with reference to the accompanying FIGS. 1-6, and with further reference to the content of U.S. Pat. No. 5,065,827, the entire disclosure of which is hereby incorporated by reference. FIG. 1 discloses the preferred but not only context for implementing the present invention.

Figure 2:
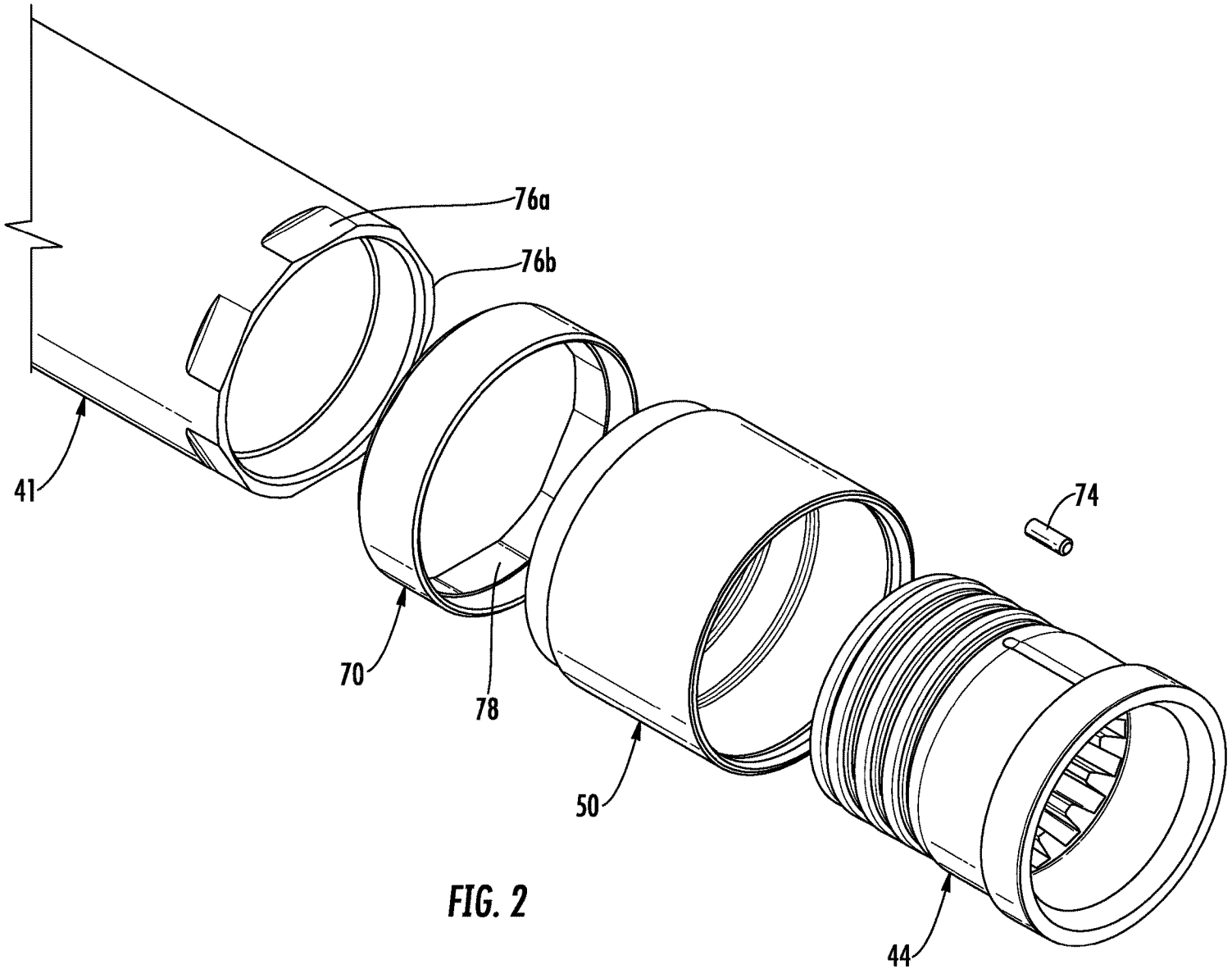
FIG. 2 shows the circumferentially spaced apart flat areas at the profiled exterior bottom of the housing and mating features on the locking sleeve according to an aspect of the invention.

The bit region 40 of a hammer drill according to FIG. 2 of the '827 patent is shown in the accompanying FIG. 1. Tubular case or housing 41 surrounds shank 62 of bit 60. The shank is hammered by a pneumatically reciprocated drive system (that is not shown and that is not part of the present invention) in order to drive head 61 of the bit through the bore hole. The drill bit retention system comprises a drive sub or chuck 44 having an upper end connectable within the lower end of the housing, a lower end, and an external shoulder 47 between the upper and lower end. A bit retainer 50 has an upper end suspendable from the shoulder of the drive sub and a lower end that extends beyond the lower end of the drive sub. The lower end of the retainer includes a radially inwardly projecting bit retention rim 52.

As shown in FIGS. 2-6, the present improvement comprises a locking sleeve or ring 70 with an upper end having an inner wall with features that are engageable with external features at the lower end of the housing 41 to prevent relative rotation, and a lower end that overlaps the upper end of the retainer 50 when the upper end of the locking sleeve engages the lower end of the housing.

The new locking sleeve 70 preferably comprises a tubular cylinder, with the upper end having an inner wall that is profiled 78 and a lower end 86 that is sized to telescopically receive the upper outer end 90 of the retainer 50 and thereby provide a circumferential joint that can be welded.

Thus, the locking sleeve 70 is connected between the retaining member 50 and the housing member 41. The locking sleeve is preferably machined for keying to the housing member 41, without freedom to rotate separately. The figures show exemplary circumferential profiles on the outer wall of the housing 41 and the inner wall of the locking sleeve 70, as recesses or flats **76*a* and rises 76*b* on the housing engaging rises 78*a* and flats 78*b* within the sleeve 70. The rises 76*b* on the housing 41** can be at the same OD as the main body of the housing.

Once assembled and tightened, the locking sleeve is then welded 72 to the retaining member 50 around the lower circumference of the sleeve, thus locking the threads 42 on the drive sub 44 from unscrewing from housing threads 43. The drive sub 44 and retaining member 50 are pinned together (as shown at 74) to stop separate rotation.

Retaining member 50 is suspended from shoulder 47 on drive sub 44 with no need for fixation because the function of the retainer 50 is only for the internal rim 52 to pull up on the external rim 67 above a broken head section 61. The present improvement is not designed to enhance the bit capture feature, but rather to prevent drive sub 44 from inadvertently unscrewing from the housing 41. Although the new locking sleeve does not directly lock the drive sub 44, it does lock the retainer 50 and since drive sub 44 is pinned to the retainer 50, the locking of the retainer 50 against rotation relative to housing 41 thereby also locks the drive sub against rotation within housing 41. The invention achieves the result that the threads of drive sub 44 are locked to housing 41 via a load path through retainer 50 and the new locking sleeve 70.

FIG. 2 generally shows the circumferentially spaced apart flat areas 76*a* and relative rise areas 76*b* at the profiled exterior bottom of the housing 41 and mating features 78 on the upper interior of locking sleeve 70.

The upper end of the sleeve has an inner wall that is profiled with thicker and thinner regions defining smaller and larger effective diameters (respectively evident in FIGS. 3 and 4), and the lower end has a uniform inside diameter 82 that is smaller than the larger effective diameter defined by the recesses 78*b* of the upper end.

Figure 5:
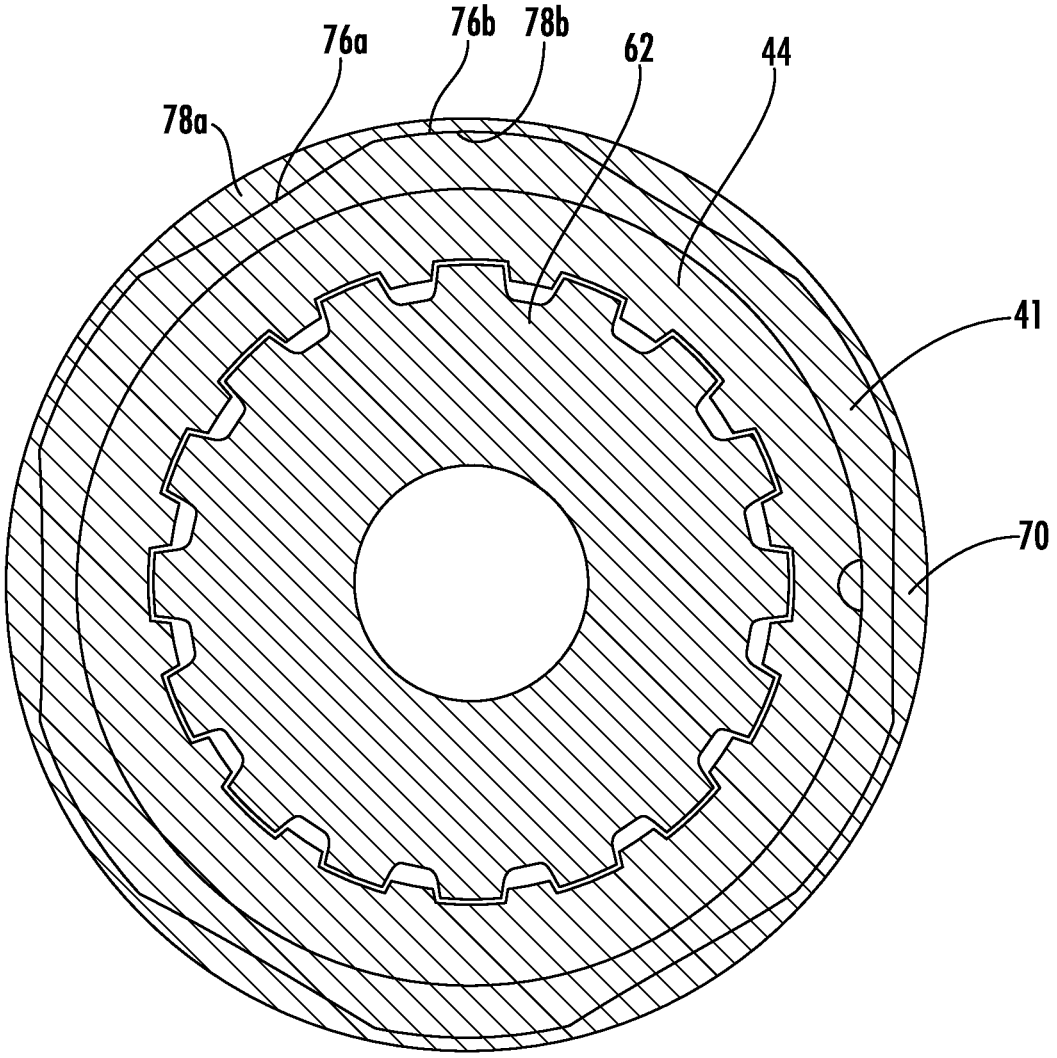
FIG. 5 is a section view through the upper portion of the sleeve that engages the housing.
Figure 6:
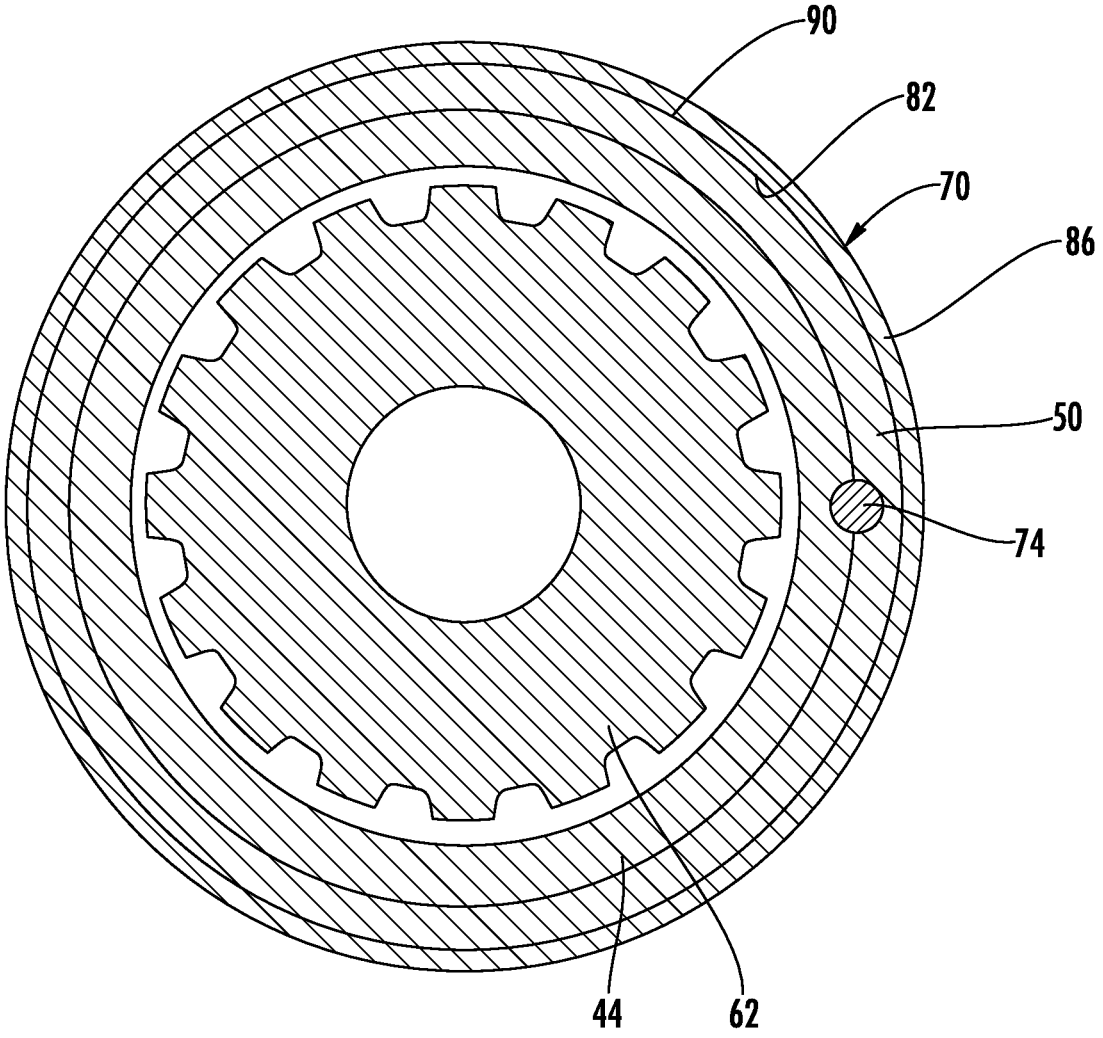
FIG. 6 is a section view through the lower portion of the sleeve that overlaps the upper portion of the retainer.

FIG. 5 is a section view through the upper portion of the sleeve 70 that engages the housing 41, whereas FIG. 6 is a section view through the lower portion of the sleeve that overlaps the upper portion of the retainer 50.

Figure 3:
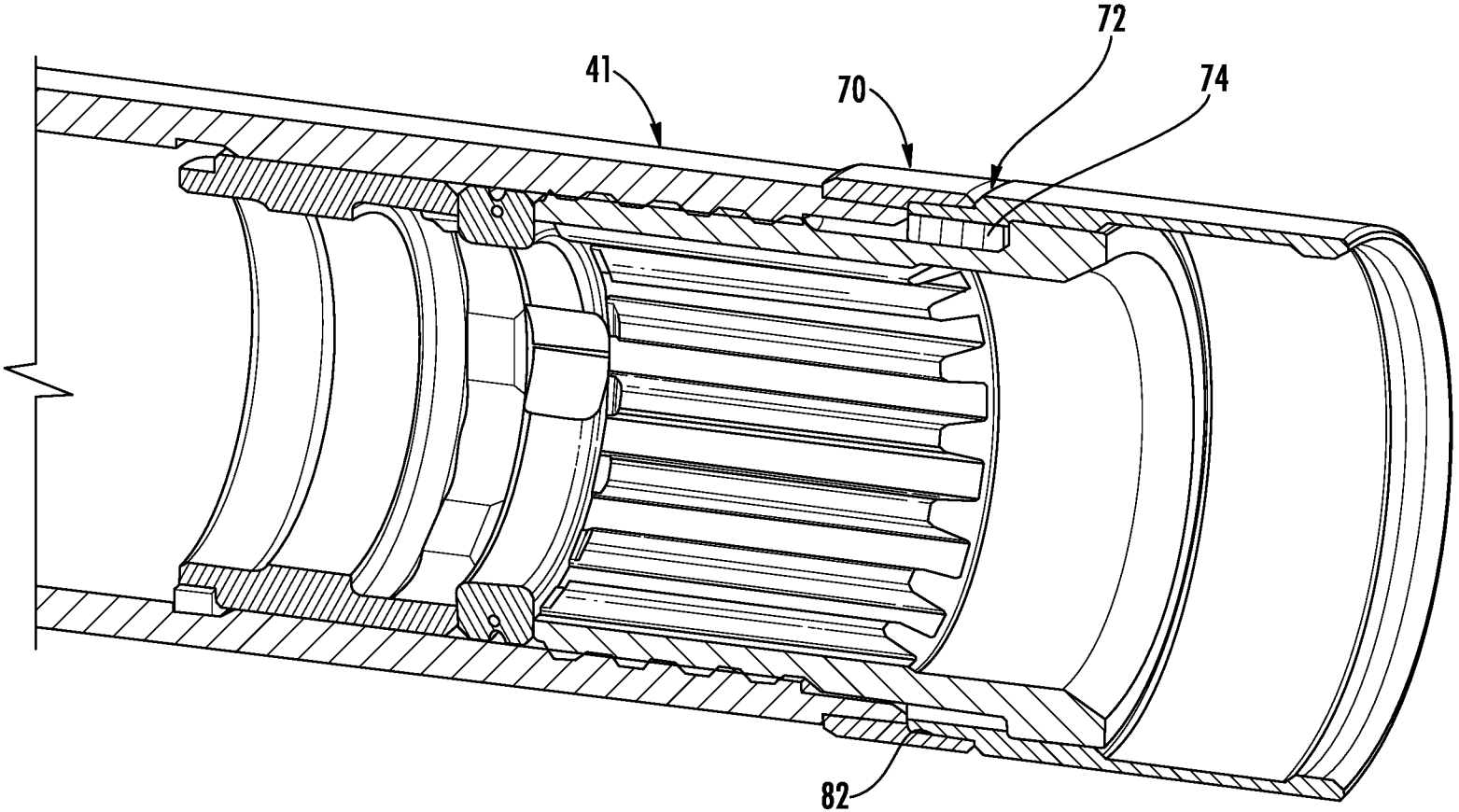
FIGS. 3 and 4 show the upper end of the sleeve that has an inner wall that is profiled with thicker and thinner regions defining smaller and larger effective diameters, respectively.
Figure 4:
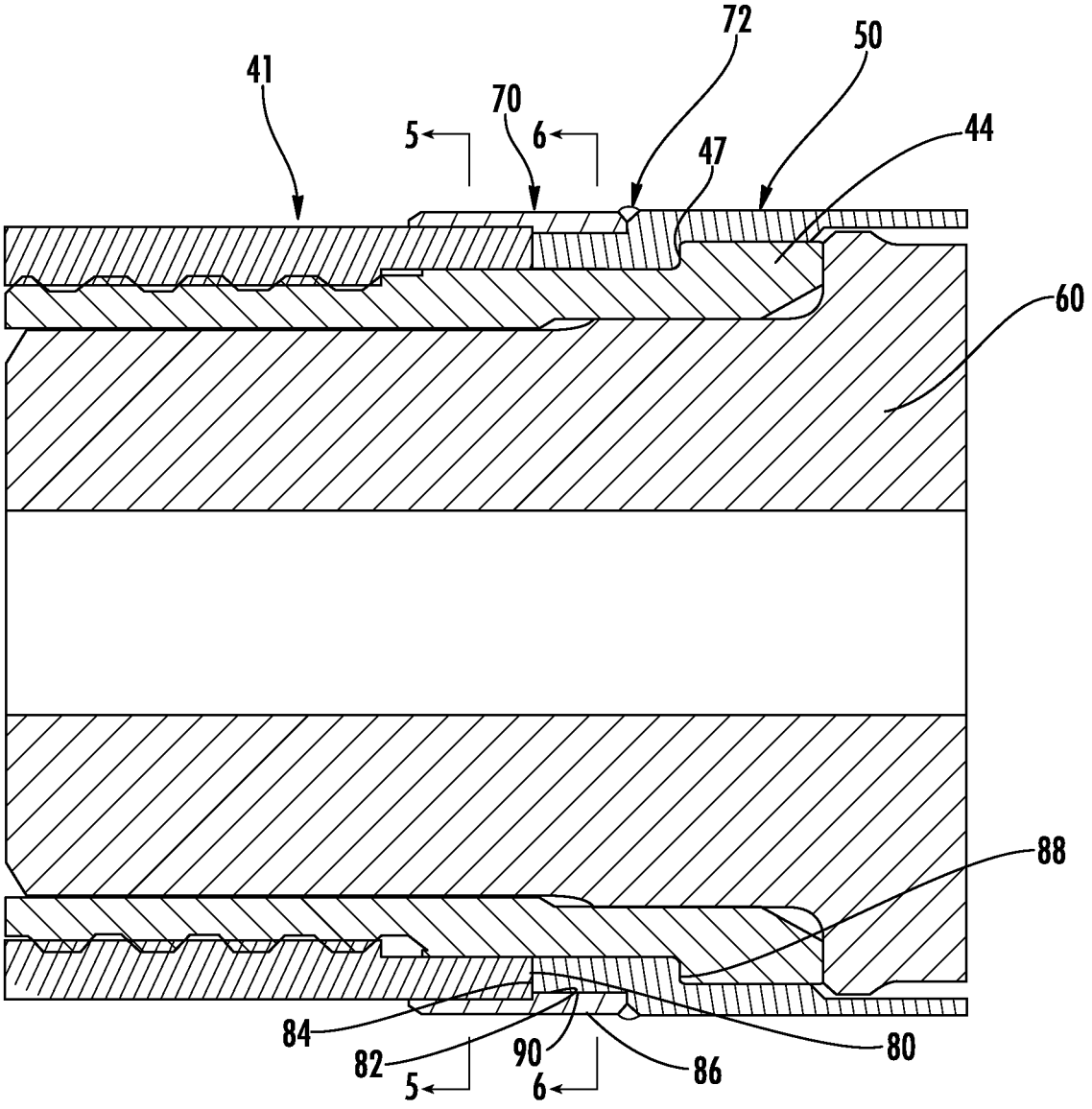

As can be understood from FIGS. 3-5, the inside diameter 82 of the lower end of the sleeve 70 is larger than the smaller effective diameter of the upper end, defined by the rises 78*a*. The retainer 50 has a reduced external diameter terminal portion 90 with a terminal edge 84 that confronts a terminal edge 80 at the lower end of the housing 41. The lower end 86 of the locking sleeve 70 overlaps the reduced external diameter terminal portion 90 of the retainer, and the upper end of the retainer has an internal shoulder 88 that mates with the shoulder 47 of the drive sub 44.

The invention claimed is:

1. A hammer-percussion bit assembly connected to the lower end of a drill string for earth boring operations comprising:

a hammer assembly within a housing for imparting kinetic energy to a percussion bit;

said percussion bit having a splined shank portion within said housing and a head section extending out of a lower end of said housing;

a drive sub externally threaded to the housing and internally mating with splines on the shank;

a retainer supported by the drive sub without permitting relative rotation between them, for retaining the head section of said bit to the housing during operation and thereafter, should the head section fracture and separate from the shank section; and a locking sleeve connected between the housing and the retainer, for preventing relative rotation between the drive sub and the housing, wherein the locking sleeve comprises upper and lower ends, with the upper end having an inner wall with features that are engageble with external features at the lower end of the housing to prevent relative rotation and a lower end sized to overlap an upper end of the retainer when the upper end of the locking sleeve engages the lower end of the housing;

wherein the retainer has a reduced external diameter terminal portion with a terminal edge that confronts a terminal edge at the lower end of the housing;

wherein the lower end of the locking sleeve overlaps the reduced external diameter terminal portion of the retainer; and wherein the upper end of the retainer has an internal shoulder that mates with a shoulder of the drive sub.

2. The hammer-percussion bit assembly of claim 1, wherein the locking sleeve comprises a tubular cylinder having upper and lower ends, with the upper end having an inner wall that is profiled with thicker and thinner regions defining smaller and larger effective inside diameters, respectively, and with the lower end having a uniform inside diameter that is smaller than the larger effective diameter of the upper end.

3. The hammer-percussion bit assembly of claim 2, wherein the inside diameter of the lower end is sized between the larger and smaller effective diameters of the upper end.

4. The hammer-percussion bit assembly of claim 1, wherein the housing, a drive sub, a retainer, and the locking sleeve form a drill bit retention system for a percussion hammer tool, wherein the drive sub comprises an upper end connectable within the lower end of the housing, a lower end, and an external shoulder between the upper and lower ends; and wherein the upper end of the retainer is suspendable from the shoulder of the drive sub and a lower end of the retainer extends beyond the lower end of the drive sub when the retainer is suspended from the drive sub, said lower end of the retainer including a radially inwardly projecting bit retention rim.

5. The hammer-percussion bit assembly of claim 1, wherein the locking sleeve has one end engaging said housing with rotational interference to prevent relative rotation between them, and another end rigidly connected to said retainer.

6. The hammer-percussion bit assembly of claim 5, wherein said retainer is supported on an external shoulder on said drive sub.

7. The hammer-percussion bit assembly of claim 5, wherein:

said retainer comprises a hollow cylindrical body with a lower end that includes an annular inwardly projecting thread portion;

the head section of said bit comprises a threaded portion and an annular recess below the threaded portion; and the annular projecting thread portion of said retention member is adapted to pass through the threaded portion of said bit during assembly and extend into said recess during operation of said hammer-bit assembly.

8. The hammer-percussion bit assembly of claim 5, wherein said retainer comprises a hollow cylindrical body supported on an external shoulder on said drive sub, and includes an annular inwardly projecting thread portion;

the head section of said bit comprises a threaded portion and an annular recess below the threaded portion; and the annular projecting thread portion of said retention member is adapted to pass through the threaded portion of said bit during assembly and extend into said recess during operation of said hammer-bit assembly.

9. The hammer-percussion bit assembly of claim 5, wherein:

said retainer comprises a hollow cylindrical body extending around said bit, and includes an annular inwardly projecting thread portion;

the head section of said bit comprises a threaded portion and an annular recess below the threaded portion; and the annular projecting thread portion of said retention member is adapted to pass through the threaded portion of said bit during assembly and extend into said recess during operation of said hammer-bit assembly.

10. The hammer-percussion bit assembly of claim 9, wherein the retainer has a reduced external diameter terminal portion with a terminal edge that confronts a terminal edge at the lower end of the housing;

the lower end of the locking sleeve overlaps the reduced external diameter terminal portion of the retainer; and the upper end of the retainer has an internal shoulder that mates with the shoulder of the drive sub.

11. The hammer-percussion bit assembly of claim 1, wherein said retainer is supported on an external shoulder on said drive sub.

12. The hammer-percussion bit assembly of claim 1, wherein:

said retainer comprises a hollow cylindrical body on which a lower end includes an annular inwardly projecting thread portion;

the head section of said bit comprises a threaded portion and an annular recess below the threaded portion; and the annular projecting thread portion of said retainer is adapted to pass through the threaded portion of said bit during assembly and extend into said recess during operation of said hammer-bit assembly.

13. The hammer-percussion bit assembly of claim 1, wherein the lower end of the locking sleeve is welded to the retainer.

14. A hammer-percussion bit assembly connected to the lower end of a drill string for earth boring operations comprising:

a hammer assembly within a housing for imparting kinetic energy to a percussion bit;

said percussion bit having a splined shank portion within said housing and a head section extending out of a lower end of said housing;

a drive sub externally threaded to the housing and internally mating with splines on the shank;

a cylindrical member supported by the drive sub without permitting relative rotation between them, wherein the cylindrical member surrounds at least the shank section of said bit; and a locking sleeve connected between the housing and the cylindrical member, for preventing relative rotation between the drive sub and the housing, wherein the locking sleeve comprises upper and lower ends, with the upper end having an inner wall with features that are engageble with external features at the lower end of the housing to prevent relative rotation and a lower end sized to overlap an upper end of the cylindrical member when the upper end of the locking sleeve engages the lower end of the housing;

wherein the cylindrical member has a reduced external diameter terminal portion with a terminal edge that confronts a terminal edge at the lower end of the housing;

wherein the lower end of the locking sleeve overlaps the reduced external diameter terminal portion of the cylindrical member; and wherein the upper end of the cylindrical member has an internal shoulder that mates with a shoulder of the drive sub.

15. The hammer-percussion bit assembly of claim 14, wherein the lower end of the locking sleeve is welded to the cylindrical member.

16. A hammer-percussion bit assembly connected to the lower end of a drill string for earth boring operations comprising:

a hammer assembly within a housing for imparting kinetic energy to a percussion bit;

said percussion bit having a splined shank portion within said housing and a head section extending out of a lower end of said housing;

a drive sub externally threaded to the housing and internally mating with splines on the shank, wherein the drive sub comprises an upper end connectable within the lower end of the housing, a lower end, and an external shoulder between the upper and lower ends; and a locking sleeve connected to the housing, wherein the locking sleeve is configured to prevent relative rotation between the drive sub and the housing, wherein the locking sleeve comprises upper and lower ends, with the upper end having an inner wall with features that are engageble with external flat features at the lower end of the housing to prevent relative rotation.

* * * * *